US007891338B2

(12) United States Patent
Ricco et al.

(10) Patent No.: US 7,891,338 B2
(45) Date of Patent: Feb. 22, 2011

(54) DEVICE FOR REGULATING PRESSURE/FLOW IN AN INTERNAL COMBUSTION ENGINE FUEL INJECTION SYSTEM

(75) Inventors: Mario Ricco, Valenzano (IT); Sisto Luigi De Matthaeis, Valenzano (IT); Annunziata Anna Satriano, Valenzano (IT); Raffaele Ricco, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 11/096,874

(22) Filed: Apr. 1, 2005

(65) Prior Publication Data

US 2006/0000448 A1 Jan. 5, 2006

(30) Foreign Application Priority Data

Jun. 30, 2004 (EP) ..... 04425479

(51) Int. Cl.
*F02M 57/02* (2006.01)

(52) U.S. Cl. ..... 123/446; 123/459

(58) Field of Classification Search ..... 123/467, 123/459, 442, 446, 447, 506
See application file for complete search history.

(56) References Cited

U.S. PATENT DOCUMENTS

| | | | | |
|---|---|---|---|---|
| 4,440,133 | A * | 4/1984 | Jourde | 123/446 |
| 4,462,369 | A * | 7/1984 | Dazzi et al. | 123/450 |
| 5,477,829 | A * | 12/1995 | Hassinger et al. | 123/467 |
| 5,850,817 | A * | 12/1998 | Bouchauveau et al. | 123/458 |
| 6,058,912 | A | 5/2000 | Rembold et al. | |
| 6,135,090 | A | 10/2000 | Kawachi et al. | |
| 6,367,454 | B1 | 4/2002 | Rembold et al. | |
| 6,609,500 | B2 * | 8/2003 | Ricco et al. | 123/446 |
| 6,619,263 | B1 | 9/2003 | Mahr et al. | |
| 6,772,738 | B2 | 8/2004 | Rembold et al. | |
| 6,988,488 | B2 * | 1/2006 | Pursifull et al. | 123/467 |
| 2002/0092505 | A1 | 7/2002 | Rembold et al. | |

(Continued)

FOREIGN PATENT DOCUMENTS

| | | |
|---|---|---|
| DE | 39 31 456 | 4/1991 |

(Continued)

OTHER PUBLICATIONS

English abstract of JP 2003-507637 from corresponding application DE 19939422 dated Mar. 1, 2001.

(Continued)

*Primary Examiner*—Stephen K. Cronin
*Assistant Examiner*—J. Page Hufty
(74) *Attorney, Agent, or Firm*—Ladas & Parry LLP

(57) ABSTRACT

The injection system (1) includes a storage volume (6) of pressurized fuel supplied by a high-pressure pump (7) along a delivery pipe (8); and a control unit (16) for defining the required fuel pressure of the storage volume (6) as a function of the operating conditions of the engine (2). The regulating device includes a bypass solenoid valve (14); and a pair of non-return valves (32, 33) connected antiparallel and located between the bypass valve (14) and the storage volume (6). One of the non-return valves (32, 33) permits fuel drainage from the storage volume (6) to the bypass valve (14) when the control unit (16) defines a predetermined reduction (Δp) in the fuel pressure of the storage volume (6).

2 Claims, 1 Drawing Sheet

U.S. PATENT DOCUMENTS

2003/0098016 A1 5/2003 Rembold et al.

FOREIGN PATENT DOCUMENTS

| | | | |
|---|---|---|---|
| DE | 197 42 180 | | 3/1999 |
| DE | 101 08 175 | | 7/2002 |
| EP | 1 312 791 | | 5/2003 |
| JP | 04012166 A | * | 1/1992 |
| JP | 6-58223 | | 3/1994 |
| JP | 11-50933 | | 2/1999 |
| JP | 2003-507637 | | 2/2003 |
| JP | 2003-106208 A | | 4/2003 |
| WO | 01/14711 | | 3/2001 |

OTHER PUBLICATIONS

English abstract of DE 3931456 dated Apr. 4, 1991.
Patent Abstracts of Japan and JPO computer English translation of JP 1150933 dated Feb. 23, 1999.
Patent Abstracts of Japan and JPO computer English translation of JP 658223 dated Mar. 1, 1994.
espacenet English abstract of JP 2003-106208 A.

* cited by examiner

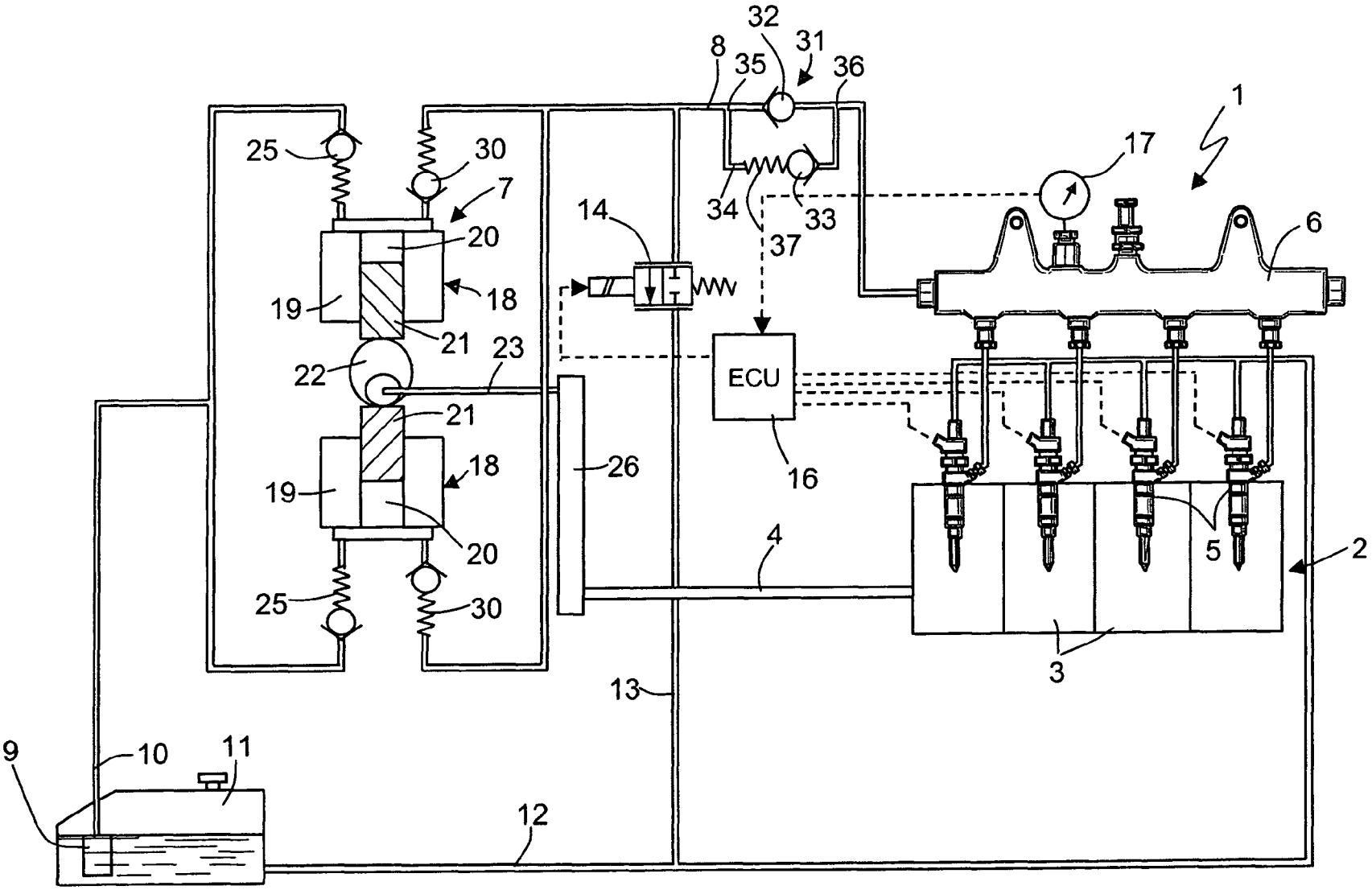
ECU

DEVICE FOR REGULATING PRESSURE/FLOW IN AN INTERNAL COMBUSTION ENGINE FUEL INJECTION SYSTEM

The present invention relates to a device for regulating pressure/flow in an internal combustion engine fuel injection system, comprising a storage volume of pressurized fuel supplied by a high-pressure pump along a delivery pipe, so as to optimize control of the system.

As is known, in modern internal combustion engines, the high-pressure pump feeds fuel to a common rail having a given fuel storage volume for supplying a number of injectors associated with the engine cylinders. For the fuel to be atomized properly, it must be brought to very high pressure, of about 1600 bars, in maximum engine load conditions; and the required common rail fuel pressure is normally defined by an electronic control unit as a function of engine operating conditions.

Injection systems are known in which a drain solenoid valve, connected directly to the common rail, is opened by the control unit when the actual pressure in the common rail is higher than required, so as to drain the surplus fuel into the fuel tank. In the event of a sudden reduction in the fuel pressure required by the operating conditions of the engine, e.g. when the vehicle is stopped immediately after a run at high engine speed, the drain solenoid valve fails to adapt the common rail fuel pressure quickly enough, so that the engine is supplied with fuel at higher than the necessary pressure, thus increasing emission noise.

Pressure regulating devices are also known comprising a bypass solenoid valve fitted to the delivery pipe of the pump, and which is controlled by the control unit to drain the newly pumped fuel directly into the tank before it reaches the common rail. One such device also comprises valve means, possibly controlled by the control unit, to drain the surplus fuel in the common rail directly into the tank in the event of a sudden reduction in the required fuel pressure.

In the above cases, since flow of the high-pressure pump normally depends on the rotation speed of the drive shaft, the pump is normally designed to provide the maximum flow and pressure required in the various operating conditions of the engine. As a result, in certain operating conditions, e.g. at maximum speed but with minimum fuel flow required by the engine, pump flow is excessive, and the surplus fuel is simply drained into the tank by the common rail drain solenoid valve or the bypass solenoid valve. Known regulating devices therefore have the drawback of dissipating part of the compression work of the high-pressure pump in the form of heat.

It is an object of the present invention to provide a device for optimizing pressure regulation of a storage volume, and so improving the efficiency of the injection system.

According to the present invention, this object is reached by a regulating device for regulating pressure/flow in a fuel injection system of an internal combustion engine, wherein a storage volume of pressurized fuel is supplied by a high-pressure pump along a delivery pipe, and wherein the required fuel pressure of the storage volume is defined by a control unit as a function of the operating conditions of the engine; said regulating device comprising a bypass solenoid valve fitted to said delivery pipe and controlled by said control unit to drain into a tank the surplus fuel pumped by said pump; characterized in that, between said bypass solenoid valve and said storage volume, valve means are provided to rapidly drain the surplus fuel from said storage volume via said bypass solenoid valve when said control unit defines a predetermined reduction in the required fuel pressure in said storage volume.

When regulating pressure/flow, said valve means therefore permit fuel flow from the storage volume to the bypass solenoid valve as long as the difference in pressure on either side of the valve means exceeds a predetermined value.

When regulating pressure/flow, only part of the fuel in the storage volume is therefore drained into the tank, so that not all the work performed on the fuel by the pump is dissipated in the form of heat.

A preferred, non-limiting embodiment of the present invention will be described by way of example with reference to the accompanying drawing, which shows a diagram of an internal combustion engine fuel injection system featuring a pressurized-fuel pressure regulating device in accordance with the invention.

Number 1 in the accompanying drawing indicates as a whole a common rail fuel injection system of an internal combustion engine 2, e.g. a four-stroke diesel engine. Engine 2 comprises a number of, e.g. four, cylinders 3, which cooperate with respective pistons (not shown) operable to rotate a drive shaft 4.

Injection system 1 comprises a number of electric injectors 5 associated with, and for injecting high-pressure fuel into, cylinders 3. Injectors 5 are connected to a storage volume, which has a predetermined volume for one or more injectors 5. In the embodiment shown, the storage volume is defined by an ordinary common rail 6, to which injectors 5 are all connected.

Common rail 6 is supplied, along a delivery pipe 8, with high-pressure fuel by a high-pressure pump indicated as a whole by 7. High-pressure pump 7 is in turn supplied by a low-pressure pump, e.g. a motor-driven pump 9, along an intake pipe 10 of pump 7. Motor-driven pump 9 is normally housed in the fuel tank 11, to which is connected a drain pipe 12 for draining surplus fuel from injection system 1, and for feeding the drain fuel from injectors 5 into tank 11.

To control the fuel pressure in common rail 6, a bypass solenoid valve 14 is also interposed between high-pressure pump 7 and common rail 6 to feed into tank 11, along a corresponding drain pipe 13, any fuel pumped in excess of that normally drawn by injectors 5, so as to maintain the required pressure in common rail 6.

The fuel in tank 11 is at atmospheric pressure. In actual use, motor-driven pump 9 compresses the low-pressure fuel, e.g. at around 2-5 bars; high-pressure pump 7 compresses the incoming fuel along intake pipe 10 to supply high-pressure fuel, e.g. at around 1600 bars, to common rail 6 along high-pressure pipe 8; and each injector 5 injects respective cylinder 3 with a quantity of fuel ranging between a minimum and maximum value, under the control of an electronic control unit 16, which may be defined by the usual microprocessor control unit of engine 2.

Control unit 16 receives signals indicating the operating conditions of engine 2, such as the accelerator pedal position and rotation speed of drive shaft 4, which are detected by corresponding sensors not shown, and the fuel pressure in common rail 6, which is detected by a pressure sensor 17. By processing the incoming signals by means of an appropriate program, control unit 16 controls when and for how long each injector 5 is activated, as well as opening and closing of solenoid valve 14.

High-pressure pump 7 comprises one or more reciprocating pumping members 18, each defined by a cylinder 19 having a compression chamber 20 in which slides a piston 21.

Each compression chamber 20 communicates with intake pipe 10 via an intake valve 25, and with delivery pipe 8 via a delivery valve 30.

Piston 21 is moved back and forth, to perform an intake stroke and a compression or delivery stroke, by eccentric cam means 22 fitted to a shaft 23 driving pump 7. In the embodiment described, two coaxial, opposite pumping members 18 are provided, and are activated by a single eccentric cam 22. Shaft 23 is connected to drive shaft 4 by a transmission device 26, so that, in the example shown, device 26 commands a compression stroke of one piston 21 for each injection by injectors 5 into respective cylinders 3 of engine 2.

According to the invention, fuel injection system 1 comprises a device for regulating the pressure in common rail 6, and which, in addition to bypass solenoid valve 14, also comprises valve means indicated as a whole by 31. Valve means 31 are located between bypass solenoid valve 14 and common rail 6, and provide for rapidly draining surplus fuel from common rail 6 into delivery pipe 8 at bypass solenoid valve 14. More specifically, valve means 31 provide for draining surplus fuel from common rail 6 into delivery pipe 8, between pump 7 and bypass solenoid valve 14, when control unit 16 defines a given sharp reduction in the fuel pressure required in common rail 6, and comprise two non-return, e.g. ball, valves 32 and 33 connected antiparallel. More specifically, a first non-return valve 32 in the pair permits fuel flow from pump 7 to common rail 6 as long as the actual fuel pressure in common rail 6 is lower than that in delivery pipe 8 of pump 7; and a second non-return valve 33 in the pair is located along a pipe 34, which communicates with delivery pipe 8 at a point 35 upstream from non-return valve 32, and at a point 36 downstream from non-return valve 32.

Non-return valve 33 permits fuel drainage from common rail 6 to bypass solenoid valve 14, so the two non-return valves 32, 33 are connected antiparallel. Both non-return valves 32, 33 are advantageously ball types and substantially similar, except that the second non-return valve 33 has an additional spring 37 of a force corresponding to a predetermined pressure reduction or threshold Δp. Spring 37 therefore only allows valve 33 to open when the difference between the actual fuel pressure in common rail 6 and the actual fuel pressure determined by bypass solenoid valve 14 in delivery pipe 8 of pump 7, at the outlet of the two delivery valves 30, exceeds threshold Δp.

Threshold Δp may advantageously be set in the region of 1000 bars. Such a reduction in pressure may occur when engine 2, after being run for a given time at high load, is suddenly operated at low load, e.g. in neutral; in which case, control unit 16 defines a low fuel pressure in common rail 6 as being best for operation of engine 2, i.e. for controlling injectors 5, and valve 33 opens to rapidly reduce pressure to the defined value. Fuel consumption and exhaust gas pollutants are thus greatly reduced, and, since not all the pressurized fuel is drained into tank 11, which is at atmospheric pressure, the work already performed by pump 7 is not dispersed or converted into heat.

The advantages, as compared with known technology, of the fuel pressure regulating device according to the invention will be clear from the foregoing description. In particular, in the event of a sudden fall in optimum pressure, as defined by the operating conditions of engine 2, the fuel pressure in common rail 6 can be adapted rapidly without dispersing the pumping work already performed, thus reducing energy consumption.

Clearly, changes may be made to the regulating device as described herein without, however, departing from the scope of the accompanying claims. For example, transmission device 26 may be eliminated, and shaft 23 of high-pressure pump 7 operated at a speed independent of that of drive shaft 4; high-pressure pump 7 may be defined by two parallel, as opposed to coaxial, pumping members 18; pump 7 may comprise other than two pumping members; and valve means 31, bypass solenoid valve 14, and delivery pipe 8 may be integrated in the body of high-pressure pump 7.

The invention claimed is:

1. A regulating device for a regulating pressure/flow in a fuel injection system of an internal combustion engine, wherein a common rail (6) of pressurized fuel is supplied by a high-pressure pump (7) along a delivery pipe (8), said high-pressure pump (7) having an intake valve (25) in communication with a low-pressure pump (9) and a delivery valve (30) in communication with said delivery pipe (8), said high-pressure pump (7) being operated in synchronism with a motor shaft (4), and wherein the required fuel pressure of the common rail (6) is defined by an electronic control unit (16) as a function of the operating conditions of the engine (2), said regulating device comprising:

a solenoid bypass valve (14) controlled by said control unit (16) to drain into a tank (11) the surplus fuel pumped by said high-pressure pump (7), said solenoid bypass valve (14) being fitted to said delivery pipe (8) downstream of said delivery valve (30); and valve means (31) provided between said bypass solenoid valve (14) and said common rail (6), said valve means (31) comprising a first non-return valve (32) to permit fuel flow from said high-pressure pump (7) to said common rail (6) as long as the actual fuel pressure in said common rail (6) is lower than that in said delivery pipe (8), and a second non-return valve (33) located along a pipe (34) communicating with said delivery pipe (8) at a first point (35) upstream from said first non-return valve (32) and at a second point (36) downstream from said first non-return valve (32) to rapidly drain the surplus fuel from said common rail (6) to said bypass solenoid valve (14) when said control unit (16) defines at least a predetermined sharp pressure-reduction threshold (Δp) of the order of 1000 bars in the required fuel pressure of said common rail (6) when the engine (2), after being run for a given time at high load is suddenly operated at low load or in neutral;

wherein said predetermined sharp pressure-reduction threshold (Δp) is formed by a difference of pressure between the actual fuel pressure in said common rail (6) and the actual fuel pressure determined by said bypass solenoid valve (14); and said second non-return valve (33) opens in response to said predetermined sharp pressure-reduction threshold (Δp) and permits the drainage of said surplus fuel from said common rail (6) to said delivery pipe (8) when said difference of pressure exceeds said predetermined sharp pressure-reduction threshold (Δp), said second non-return valve (33) being loaded by an additional spring (37) of a force corresponding to said predetermined sharp pressure-reduction threshold (Δp).

2. In a regulating device of a regulating pressure/flow in a fuel injection system for an internal combustion engine, wherein a delivery pipe (8) supplies a common rail (6) with fuel from a high-pressure pump (7), said high-pressure pump (7) being operated in synchronism with a drive shaft (4) of said internal combustion engine, and wherein a required pressure said fuel supplied said common rail (6) is defined by an electronic control unit (16) as a function of the operating conditions of said internal combustion engine (2), the improvements comprising:

a solenoid bypass valve (14) controlled by said control unit (16) to drain surplus fuel from said delivery pipe (8) when said control unit (16) defines at least a predetermined sharp pressure-reduction threshold (Δp) in a pressure of said fuel pressure required in said common rail (6); and valve means (31) between said bypass solenoid valve (14) and said common rail (6), said valve means (31) comprising a first non-return valve (32) to permit said fuel supply from said high-pressure pump (7) to said common rail (6) as long as actual pressure of said fuel in said common rail (6) is lower than in said delivery pipe (8), and a second non-return valve (33) located along a pipe (34) communicating with said delivery pipe (8) at a first point (35) upstream from said first non-return valve (32) and at a second point (36) downstream from said first non-return valve (32) for said drain of said fuel from said common rail (6) to said bypass solenoid valve (14) when said control unit (16) defines said at least predetermined sharp pressure-reduction threshold (Δp);

wherein said predetermined sharp pressure-reduction threshold (Δp) is formed by a difference of pressure between said actual fuel pressure in said common rail (6) and a fuel pressure determined by said bypass solenoid valve (14) and said second non-return valve (33) is loaded by an additional spring (37) of a force corresponding to said predetermined sharp pressure-reduction threshold (Δp).

* * * * *